United States Patent [19]

Göransson

[11] 4,168,065

[45] Sep. 18, 1979

[54] RACKET

[76] Inventor: Gunnar P. M. Göransson, Folkungagatan 136, S-116 30 Stockholm, Sweden

[21] Appl. No.: 783,119

[22] Filed: Mar. 31, 1977

[30] Foreign Application Priority Data

Apr. 2, 1976 [SE] Sweden ..... 7603961

[51] Int. Cl.[2] ..... A63B 51/00

[52] U.S. Cl. ..... 273/73 D

[58] Field of Search ..... 273/67 R, 73 R, 73 C, 273/73 D, 96 R, 96 D, 29 A, 175

[56] References Cited

U.S. PATENT DOCUMENTS

| | | | |
|---|---|---|---|
| 1,682,199 | 8/1928 | Smilie | 273/73 D |
| 3,545,756 | 12/1970 | Nash | 273/73 D |
| 3,820,785 | 6/1974 | Occhipinti et al. | 273/73 D X |
| 3,921,979 | 11/1975 | Dischinger | 273/73 D X |
| 4,013,289 | 3/1977 | Kaminstein | 273/73 D |
| 4,076,241 | 2/1978 | Newsome | 273/73 D |
| 4,078,796 | 3/1978 | Gibello | 273/73 D |
| 4,082,275 | 4/1978 | Soong et al. | 273/73 D |

FOREIGN PATENT DOCUMENTS

| | | | |
|---|---|---|---|
| 786619 | 6/1935 | France | 273/73 D |
| 24856 | of 1913 | United Kingdom | 273/73 D |

*Primary Examiner*—Richard J. Apley

*Attorney, Agent, or Firm*—Sughrue, Rothwell, Mion, Zinn and Macpeak

[57] ABSTRACT

Racket with the racket head built up by crossing strings fastened to a frame, especially a tennis racket. Both the main surfaces of the racket head have a concave profile over at least a portion of each surface in at least one dimension of the racket head. The concave profile is provided by distance pieces or spaceers of different thicknesses inserted between the strings at various crossing points.

7 Claims, 3 Drawing Figures

RACKET

This invention relates to rackets having their racket heads built up by crossing strings fastened to a frame, for example tennis rackets.

On a conventional tennis racket both the surfaces of the racket head built up by the strings are in principle plane. In the hard and tough tennis of today very topped strokes are often used, that is strokes at which the racket is caused to move upwards at the same time as it is moved towards the ball which then is given a rotary motion so called overspin around a substantially horosontal axle through the centre of the ball. At such strokes the ball tends to slide uncontrollably on the plane surface of the racket head even due to very slight misjudgements of the player. The same also applies concerning so called sliced strokes and highly twisted services.

A main object of the present invention is to obtain a racket of the above mentioned kind at which each surface of the racket head is so designed that the risk of the stroke to fail due to a slight misjudgement of the player is reduced and such that the effect of the above mentioned twisted strokes are amplified.

According to the invention this object is obtained by given at least a portion of each of the two main surfaces of the racket head a concave profile in at least one dimension of the racket head. This reduces the risk of the ball to slide off the surface in connection with a highly twisted stroke.

In one embodiment of the invention the concave profile is obtained by means of distance pieces of different thicknesses which are arranged between the strings at their crossing points. In addition to said concave profile said distance pieces also result in an essentially improved grip of the ball which in turn result in an amplified effect of twisted strokes.

The expressions "concave" and "concave profile" used above and in the following description and in the claims are intended to cover any modification of the previous plane surfaces of the racket head which gives these surfaces a concave profile over at least a portion in any direction. The slopes of such concave profiles do not have to be symmetrical and the pitches can be different over different portions eventually spaced by substantially plane portions.

Although the surfaces of the racket head can be concave all over it has been discovered that a considerable effect is obtained already by making only a minor portion of each surface concave only in one dimension of the surface. For improving the above mentioned strokes this dimension should coincide with the transverse direction of the surfaces of the racket head. Said concave portion may advantageously include a substantially plane centre portion which laterally towards the racket frame is transformed into slightly inclined portions which in turn are transformed into substantially plane portions adjacent to the frame.

The distance pieces such for obtaining the desired concavity should be flexible. Preferably distance pieces placed closer to the racket frame are made of a more flexible material than distance pieces placed closer to the centre of the racket head. The material of the distance pieces should be selected to give a high friction against both the strings and the ball.

The invention will be described below with reference to the accompanying drawing showing a preferred embodiment of the invention.

Figure 1:
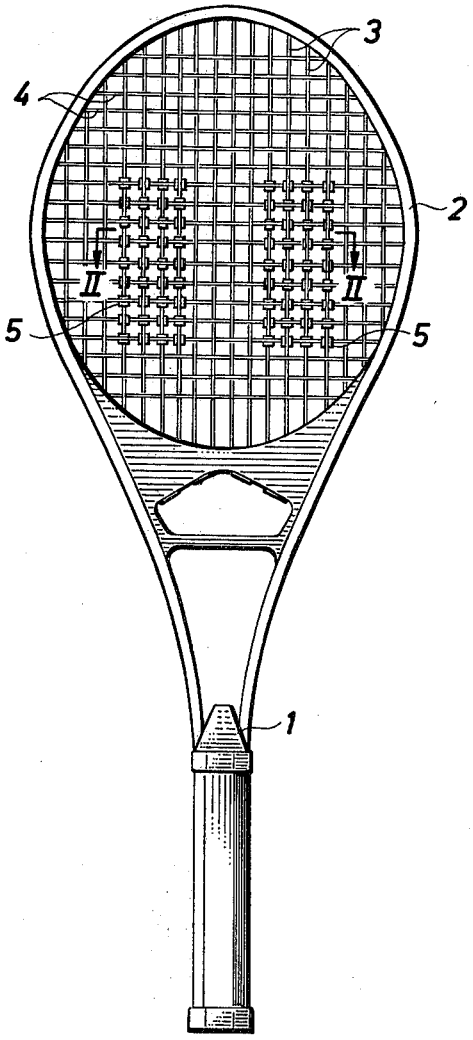
FIG. 1 is a plan view of one embodiment of the racket according to the invention.

The tennis racket of FIG. 1 comprises a handle 1 which is transformed into a frame 2 to which crossing strings 3 and 4 are fastened for the formation of two identical surfaces one at each side of the racket.

Figure 3:
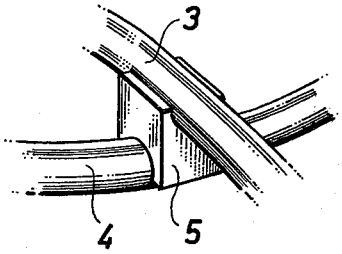
FIG. 3 illustrates a crossing point between two strings spaced apart by a distance piece.
Figure 2:
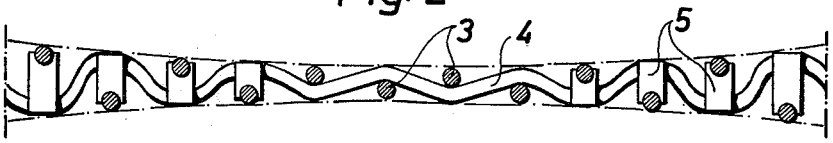
FIG. 2 is a cross section through a portion of the racket head along the line II—II in FIG. 1 in a larger scale and with exaggerated dimensions of the distance pieces.

In this embodiment distance pieces 5 have been mounted betewen the strings 3 and 4 at certain crossing points as illustrated in FIG. 3. The cross section of FIG. 2 shows in an exaggerated manner that the distance pieces 5 have an increasing thickness from the centre of the racket head and towards the racket frame 2 viewed in the transverse dimension of the racket head. However, in this embodiment the distance pieces 5 mounted along one and the same longitudinal string 3 have the same thickness.

By means of the distance pieces 5 designed and placed as shown both surfaces of the racket head receive identical concave profiles in the transverse direction including a substantial plane centre portion which laterally towards the racket frame is transformed into slightly inclined portions which in turn are transformed into plane portions adjacent to the frame. The latter plane portions may be obtained by using distance pieces having constant thickness or by excluding the distance pieces in the portions adjacent to the frame. In the same way the plane centre portion can be obtained by using very thin distance pieces having constant thickness or as illustrated in FIG. 3 by excluding the distance pieces in that portion. However, the use of thin distance pieces gives the positive effect that the tendency of the strings to be displaced relatively each other when the ball hits the strings is reduced.

One effect of providing both the surfaces of the racket head with a concave portion according to the embodiment described is that even if the player makes a slight misjudgment of a topped or sliced stroke the ball does not tend to slide along the surface in an uncontrollable way. Further, the use of distance pieces results in a considerable better grip between the ball and the racket head as said pieces form impressions in the ball when it hits the racket head.

In order to improve the springing characteristic of the racket head the distance pieces are made of a flexible material and preferably the distance pieces placed closer to the racket frame are made of a more flexible material than the distance pieces placed closer to the centre of the racket head. By selecting the material of the distance pieces so that it render a high friction against the strings the advantage is also obtained that the tendency of the strings to be displaced relatively each other due to the ball hitting the strings is reduced to a great extent. For instance the distance pieces can be made of so called friction rubber. Further, the distance pieces are manufactured with such thicknesses that any desired pitch profile can be obtained.

In the above described embodiment the main surfaces of the racket head have a concave profile only in the transverse dimension. However, a corresponding profile may naturally also be obtained in the longitudinal dimension by inserting distance pieces along the longitudinal strings 3 which pieces have an increasing thickness from the centre of the racket head and towards the frame. Further, the plane centre portion may be eliminated by using also in said portion distance pieces having a decreasing thickness towards the centre of the racket head. In that case the concavity will begin at the centre of the racket head. Further, distance pieces having an increasing thickness from the centre of the racket head and towards the frame can be inserted in all the crossing points between the strings which will result in a concavity of pyramidal form. The distance pieces can also be so selected that the slopes defining the concavity can have different pitches, profiles and lengths in different directions.

It is preferred to use distance pieces for obtaining the desired concavity as then identical concavities are obtained on each side of the racket head. However, there are also other possibilities. For instance it may be possible to use relatively thick springs and to grind them for obtaining the desired concavity. Thus, the invention is not limited only to the use of distance pieces.

What is claimed is:

1. In a game racket including a racket head built up by crossing strings fastened to a frame, the improvements characterized by: a portion of each of the two main surfaces of the racket head having a concave profile in one dimension of the racket head, said concave profile being provided by distance pieces of different thicknesses arranged between the strings at some of the crossing points therebetween.

2. Racket according to claim 1, wherein each of said surfaces of the racket head has a portion with a concave profile in the transverse direction of the racket head.

3. Racket according to claim 2, wherein said concave profile comprises a substantially planar portion at the center of the corresponding surface.

4. Racket according to claim 2, wherein said concave profile at each end is transformed into a planar portion adjacent to the racket frame.

5. Racket according to claim 1, wherein said distance pieces are flexible.

6. Racket according to claim 5, wherein distance pieces placed closer to the racket frame are more flexible than distance pieces placed closer to the center of the racket head.

7. Racket according to claim 1, wherein the material of said distance pieces has a high coefficient of friction with the racket strings.

* * * * *